US005628046A

United States Patent [19]

Dautzenberg et al.

[11] Patent Number: 5,628,046

[45] Date of Patent: May 6, 1997

[54] PROCESS FOR PREPARING A POWDER MIXTURE AND ITS USE

[75] Inventors: Norbert Dautzenberg, Wegberg; Karl-Heinz Lindner, Mülheim; Klaus Vossen, Meerbusch, all of Germany

[73] Assignee: Mannesmann Aktiengesellschaft, Dusseldorf, Germany

[21] Appl. No.: 537,878

[22] PCT Filed: Sep. 9, 1994

[86] PCT No.: PCT/DE94/01087

§ 371 Date: Oct. 31, 1995

§ 102(e) Date: Oct. 31, 1995

[87] PCT Pub. No.: WO95/08006

PCT Pub. Date: Mar. 23, 1995

[30] Foreign Application Priority Data

Sep. 16, 1993 [DE] Germany ..... 43 31 938.6
Jun. 9, 1994 [DE] Germany ..... 9409832 U

[51] Int. Cl.[6] ..... B22F 3/12; B22F 9/08; C22C 38/12

[52] U.S. Cl. ..... 419/38; 419/11; 419/57; 419/58; 75/231; 75/246; 75/355; 75/950

[58] Field of Search ..... 419/11, 38, 57, 419/58; 75/355, 231, 246, 950

[56] References Cited

U.S. PATENT DOCUMENTS

| | | | |
|---|---|---|---|
| 3,901,661 | 8/1975 | Kondo et al. | 29/182 |
| 4,253,874 | 3/1981 | Cundill | 75/246 |
| 4,331,478 | 5/1982 | Ro et al. | 75/228 |
| 4,350,529 | 9/1982 | Ro et al. | 75/228 |
| 4,382,818 | 5/1983 | Mocarski | 419/11 |
| 4,569,823 | 2/1986 | Westin | 419/23 |
| 4,702,772 | 10/1987 | Engström et al. | 75/243 |
| 4,880,461 | 11/1989 | Uchida | 75/238 |
| 5,009,842 | 4/1991 | Hendrickson et al. | 419/28 |
| 5,108,492 | 4/1992 | Kiyota et al. | 75/246 |
| 5,217,683 | 6/1993 | Causton | 419/38 |
| 5,238,482 | 8/1993 | Stasko et al. | 75/338 |
| 5,403,371 | 4/1995 | Engdahl et al. | 75/230 |
| 5,427,600 | 6/1995 | Itoh et al. | 75/232 |
| 5,522,914 | 6/1996 | Stasko et al. | 75/231 |
| 5,552,109 | 9/1996 | Shivanath et al. | 419/53 |

*Primary Examiner*—Charles T. Jordan
*Assistant Examiner*—Daniel Jenkins
*Attorney, Agent, or Firm*—Cohen, Pontani, Lieberman, Pavane

[57] ABSTRACT

A process for fabrication of sintered articles from a molybdenum-containing steel alloy by atomization, pressing, and sintering. The melt used for atomization has a molybdenum content determined as a function of the sintering temperature which lies in a range of 1050°–1350° C. The carbon content of the powder mixture is no more than 0.05% by weight and the reduction annealing takes place in a temperature range of 850°–950° C.

23 Claims, No Drawings

PROCESS FOR PREPARING A POWDER MIXTURE AND ITS USE

BACKGROUND OF THE INVENTION

1. Field of Invention

The invention is directed to a process for producing compression ready a powder mixture of steel powder and to the use of such a powder mixture for fabricating sintered articles with high toughness and density.

2. Description of the Prior Art

The fabrication of mechanical structural component pans from ferrous materials by way of sintering techniques, as opposed to production by cutting or chip-removing machining (e.g., turning, boring, milling), has the great advantage that the actual shaping can be effected in a single work step practically without waste and is therefore faster and more economical for duplicated or series-produced articles. For example, the articles are pressed to form green compacts on a hydraulic metal powder press in a die using a pressing pressure of 7 t/cm$^2$, for instance, and are then sintered in a furnace at approximately 1120°–1150° C. (normal sintering) or at approximately 1250°–1280° C. (high-temperature sintering) in order to gain a sufficient static and dynamic strength. Owing to conditions of fabrication, the density of the sintered articles is always lower than that of the corresponding solid work material (theoretical density), since the articles are penetrated by pores. In ferrous materials, the actual density of the sintered articles is normally in the range of roughly 80–92% of the theoretical density depending on the applied pressing pressure and the shape of the article. This inevitably leads to impairment of the mechanical properties, of the article. Due to this sintered articles were previously not used under particularly high mechanical stresses, especially since greater dimensioning to compensate for this disadvantage is generally not acceptable due to the resulting increase in volume and weight. In addition, the pores contained in the sintered article can act as inner notches which in particular can lead to a drastic reduction of the dynamic strength characteristics.

In order to reduce the pore volume of sintered articles, it is known to use ferrous base powder with a higher phosphorous content. This leads to noticeable shrinkage during the sintering process and accordingly to an increase in density. The shrinkage of the sintered article is taken into account in the geometrical form of the press die by means of suitable overdimensioning and can accordingly be compensated to a great extent. However, the addition of phosphorous, which can be effected either by appropriate alloying of the melt used in the powder atomization or by admixture of phosphorous compounds with the ferrous base powder, has the disadvantage that it can only be used to a limited extent to increase density, since higher phosphorous contents tend to produce brittleness in the sintered articles and accordingly further increase susceptibility to notching.

Another method for achieving a higher density, i.e., for reducing the pore volume, is the so-called double sintering technique in which the compacted body, after first being sintered generally at a temperature of approximately 700°–900° C., is subjected to another pressing process and a final finish sintering. This is a very cost-intensive process due to the double pressing and sintering.

A ferrous base powder which ensures a comparatively high impact strength is known from WO 91/19582. The prescribed alloying elements compulsorily contain 0.3–0.7 percent by weight phosphorous and 0.3–3.5 percent by weight molybdenum. The sum total of any other alloying elements which may be present is limited to a maximum of 2 percent by weight. The molybdenum content is preferably 0.5 to 2.5 percent by weight and the phosphorous content is preferably 0.4 to 0.6 percent by weight (added in the form of $Fe_3P$ in particular). A maximum carbon content of 0.07 percent by weight is recommended. This ferrous base powder is suitable for normal sintering temperatures (below 1450° C.). The test results presented in this reference show that there are optimum quantitative proportions for both phosphorous and molybdenum at which the impact strength is especially high. Thus the impact strength increases sharply in a powder with a phosphorous content of 0.5 percent by weight and a molybdenum content of 0 to 1.0 percent by weight, reaches a maximum in the range of 1 to 2 percent by weight, and even drops below the starting value beyond a molybdenum content of 3.5 percent by weight.

Further, DE 29 43 601 C2 discloses a pre-alloyed steel powder for the fabrication of high-strength sintered articles which contains 0.35 to 1.50 % Mn, 0.2 to 5.0% Cr, 0.1 to 7.0% Mo, 0.01 to 1.0 V, a maximum 0.10% Si, a maximum 0.01% Al, a maximum 0.05% C, a maximum 0.004% N, a maximum 0.25% oxygen, remainder iron and other fabrication-related impurities. The low carbon content is required to enable a good compressibility of the steel powder which is produced by water atomization of a corresponding melt and subsequent reduction annealing at 1000° C. Before being compressed to form green compacts, this steel powder is mixed, as is conventional, with lubricants (e.g., 1% zinc stearate) and, in addition, with graphite powder in order to adjust the desired carbon content in the sintered article. The added amount of graphite powder is generally several tenths of a percent (e.g., 0.8%), since the sintered articles are oil-hardened after sintering so as to acquire sufficient strength values. The compression ready metal powder mixture must therefore have a sufficiently high carbon content for a heat-treatable steel while allowing for the anticipated burnup losses during sintering. Due to the carbon content, the sintering process inevitably produces a structure comprising martensite or martensite and bainite or bainite and pearlite, depending on the cooling rate. In order to achieve a density close to the theoretical density of steel, the sintered articles are subjected to a forging process prior to heat treatment.

Toothed gear wheels which are subjected to high mechanical stresses must have a high flank bearing capacity in addition to the highest possible root fatigue strength. Therefore such toothed gear wheels are normally hardened. However, in the case of a work material with relatively high phosphorous content this leads to an unacceptable embrittlement of the structural component part.

SUMMARY OF THE INVENTION

Therefore, the object of the present invention is to provide a process of the generic type for preparing a compression-ready steel powder mixture for the fabrication of sintered articles with high density which have, in particular, good dynamic strength properties with good surface hardenability and which can accordingly be used for structural component parts capable of withstanding particularly high mechanical loading without the use of the costly double sintering technique or a forging process, in particular for toothed gear wheels for automobile transmissions and similarly stressed structural component parts. The invention also provides for the use of the powder mixture according to the invention for the fabrication of such structural component parts.

In a completely surprising manner, it was found that a steel powder which is produced, e.g., by gas atomization, gas-liquid atomization or preferably by water atomization of a molybdenum-containing steel melt and subsequent reduction annealing and spheroidizing or soft-annealing at 850°–950° C. can be processed after mixing with conventional powder-metallurgical lubricants (e.g., zinc stearate) to form structural component parts having only an extremely small pore volume, i.e., a density (e.g., 95 to 98%) verging on the highest possible theoretical density of the work material. This requires only a simple pressing using conventional pressures in the range of 6.0 and 8.0 t/cm$^2$, preferably 6.5 to 7.5 t/cm$^2$. The sintering temperatures can be in the region of 1050° to 1350° C., higher temperatures being preferable. This means temperatures up to about 1150° C. in conveyor furnaces and temperatures of roughly 1250° to 1300° C. (high-temperature sintering) in walking beam or rocker bar furnaces. Compared with normal sintering, greater densities can be achieved by high-temperature sintering.

The powder mixture according to the invention is characterized in that it is practically free of phosphorous and thus only contains phosphorous as an impurity (P<0.02 percent by weight). The minimum required molybdenum content in the steel melt to be used for producing the powder depends upon the sintering temperature used during the subsequent fabrication of the sintered articles. A content of 4.0 percent by weight is already considered sufficient in every case. For reasons of economy, an upper limit of 5 percent by weight, preferably even only 4.5 percent by weight, should not be exceeded. At a sintering temperature of 1120° C., a molybdenum content of 3.8 percent by weight is sufficient, and at 1280° C. even a molybdenum content of 2.7 percent by weight is adequate. However, due to the melt tolerances to be allowed for, caution recommends that this lower limiting value be increased by 0.5 percent by weight to 4.3 percent by weight or 3.2 percent by weight, for example. The minimum required molybdenum content can be determined as follows based on the sintering temperature $T_s$:

$$\text{Mo (percent by weight)} = 16.1\frac{T_s}{100°} - 0.7\left(\frac{T_s}{100°}\right)^2 - 88.7$$

The steel melt to be atomized must not only be practically free of phosphorous, but also must not have an appreciable carbon content (C<0.01% by weight) so that the powder remains sufficiently soft and easily compressible. In individual cases, the strength can be increased by admixing graphite with the powder, although even this should be avoided as far as possible. But, at most, this should result in a carbon content of 0.06 percent by weight in the powder mixture. The carbon content is preferably limited to a maximum of 0.04 percent by weight, in particular, to a maximum of 0.02 percent by weight. For the remainder, the powder can contain the conventional impurities of a steel melt. Additional metallic alloy additions apart from molybdenum are not required, but are generally not prejudicial provided their values are not too high. The total content of these additional alloying elements should not exceed 1.0 percent by weight, preferably not over 0.5 percent by weight. The addition of chromium (preferably without additional alloying elements) within the aforementioned limits may be advisable in order to increase the strength of the alloy.

When processing the powder mixture according to the invention, it is advantageous to carry out the sintering process in a reducing atmosphere, in particular in an atmosphere containing a minimum of 10 percent by volume, preferably 20 to 40 percent by volume, hydrogen. The precipitation of nitrides can be prevented or reduced to a minimum in this way. The use of forming gas or shielding gas, i.e., a mixture of $H_2$ and $N_2$, may be advisable, for example. Higher $H_2$ contents tend to improve the attainable density in sintering which is effected exclusively in the alpha phase due to the adjustment of the powder mixture according to the invention and is therefore highly beneficial for dense sintering (without formation of a liquid phase). After sintering, no special measures are required for cooling. The sintered articles have a purely ferrite structure of FeMo mixed crystals.

The sintered articles can be subjected to sizing subsequently, resulting in a deformation in the surface region (smoothing of roughness) and accordingly in an improved surface quality and dimensional stability. Case-hardening can then be carded out in a known manner. This is advisable in particular for toothed gear wheels and similarly stressed articles, since it leads to a substantial increase in surface hardness and the introduction of internal compressive stresses. In the case of toothed gear wheels, it is advisable to subject the toothed region to soft shaving prior to case-hardening. After the toothed gear wheels are case-hardened, conventional shaving of bores and plane surfaces can be carded out.

The sintered articles produced in this way have a density close to the maximum theoretical density. It is particularly remarkable that the remaining pores are small, self-contained, and circular and therefore do not exhibit appreciable notching. This results in excellent dynamic strength values and also, after case-hardening, in high surface hardness at the same time which is critical for wear resistance and, e.g., the tooth-flank beating capacity.

DETAILED DESCRIPTION OF A PREFERRED EMBODIMENT

A fine, spattered steel powder is produced by water atomization from a steel melt containing (in percent by weight):

| |
|---|
| <0.01% C |
| <0.02% P |
| 3.2% Mo |
| remainder iron and conventional impurities (<0.5%). |

After reduction annealing for about 70 minutes at approximately 900° C., the powder, having a residual oxygen content of less than 0.15 percent by weight and a particle size after sieving of less than 0.2 mm, was mixed with microwax (0.8 percent by weight) as a lubricant. Test pieces based on ISO 2740 were produced from this material on a hydraulic metal powder press with a pressing pressure of 7 t/cm$^2$ and then sintered for approximately 30 minutes at a temperature of 1280° C. in a furnace in a shielding gas atmosphere (80% $N_2$, 20% $H_2$). Some of the test pieces were then case-hardened at 920°–950° C. in a furnace with a C-potential of 0.8% resulting in a case depth of roughly 0.4 mm. Analysis of the test pieces yielded the following values:

| | |
|---|---|
| sintering density | 7.60 ± 0.04 g/cm$^3$ (96–97% of theoretical density) |

fatigue strength under reversed bending stresses at $2\times10^6$ loading approx. 450 MPa after case-hardening and approx. 180 MPa without case-hardening elongation at rupture sintered $A_5$>25%.

We claim:

1. A process for producing a compression-ready powder mixture of steel powder for fabricating sintered articles with high toughness and density, the process comprising the steps of:

atomizing a carbon and phosphorous containing molybdenum steel melt having conventional impurities, molybdenum content of the melt being determined as a function of a sintering temperature $T_s$ lying in a range of approximately 1050°–1350° C. and amounting to at least $$\text{Mo (percent by weight)} = 16.1\frac{T_s}{100°} - 0.7\left(\frac{T_s}{100°}\right)^2 - 88.7,$$

limiting carbon content of the powder mixture to a maximum 0.05% by weight;

reduction annealing the melt in a temperature range of 850°–950° C.;

soft-annealing; and adding conventional lubricants.

2. A process according to claim 1, wherein the atomizing step takes place as water atomizing.

3. A process according to claim 1, and further comprising the step of mixing small quantities of graphite powder in the melt for adjusting carbon content.

4. A process according to claim 1, including limiting a total content of other metallic alloying elements in the melt to a maximum of 1.0% by weight.

5. A process according to claim 4, including limiting total content of other metallic alloying elements in the steel melt to a maximum of 0.5% by weight.

6. A process according to claim 4, including adding chromium to the melt.

7. A process according to claim 4, wherein the chromium adding step includes adding chromium without other additional alloying elements.

8. A process according to claim 1, wherein the atomizing step includes atomizing a melt with a molybdenum content that is at least 3.2% by weight for a sintering temperature of 1280° C.

9. A process according to claim 1, wherein the atomizing step includes atomizing a melt with a molybdenum content that is at least 4.3% by weight for a sintering temperature of 1120° C.

10. A process according to claim 1, including limiting the molybdenum content of the melt to a maximum of 5.0% by weight.

11. A process according to claim 10, wherein the molybdenum limiting step includes limiting the molybdenum content of the melt to a maximum of 4.5% by weight.

12. A process according to claim 3, including limiting the carbon content to a maximum of 0.04% by weight.

13. A process according to claim 12, including limiting the carbon content to a maximum of 0.02% by weight.

14. A process for fabricating sintered articles with high toughness and density, comprising the steps of:

preparing a compression-ready powder mixture of steel powder by atomizing a carbon and phosphorous containing molybdenum steel melt with conventional impurities, which melt has a molybdenum content determined as a function of sintering temperature $T_s$ lying in a range of approximately 1050°–1350° C., which amounts to at least $$\text{Mo (percent by weight)} = 16.1\frac{T_s}{100°} - 0.7\left(\frac{T_s}{100°}\right)^2 - 88.7;$$

limiting the carbon content of the powder mixture to a maximum of 0.05% by weight, reduction annealing the melt in a temperature range of 850°–950° C., soft annealing and adding conventional lubricants;

forming the powder mixture into green compacts;

compressing the green compacts by simple compression techniques at a pressing pressure of 6.0 to 8.0 t/cm$^2$; and subsequently sintering the compressed green compacts at a temperature in a range of 1050°–1350° C. under an atmosphere containing at least 10% by volume hydrogen, so that articles having a ferrite structure are produced.

15. A process as defined in claim 14, wherein the sintering step includes sintering in an $N_2/H_2$ atmosphere.

16. A process according to claim 15, wherein the $N_2/H_2$ atmosphere has an $H_2$ component of 20 to 40% by volume.

17. A process according to claim 16, wherein the compressing step includes compressing at a pressing pressure of 6.5 to 7.5 t/cm$^2$.

18. A process according to claim 14, wherein the sintering step includes sintering at a temperature of 1250°–1300° C.

19. A process according to claim 14, further including subsequently sizing the sintered articles.

20. A process according to claim 14, further including case-hardening the sintered articles.

21. A process according to claim 19, wherein the articles are fabricated as toothed gear wheels, the process further including case-hardening the sintered and sized toothed gear wheels.

22. A process according to claim 21, further including shaving the sintered and sized soothed gear wheels in a toothed region prior to the case-hardening.

23. A sintered article with high toughness and density produced from a compression-ready powder mixture of steel powder prepared by atomizing a carbon and phosphorous containing molybdenum steel melt with conventional impurities and having a molybdenum content determined as a function of sintering temperature $T_s$ lying in a range of approximately 1050°–1350° C. which amounts to at least $$\text{Mo (percent by weight)} = 16.1\frac{T_s}{100°} - 0.7\left(\frac{T_s}{100°}\right)^2 - 88.7,$$

limiting carbon content of the powder mixture to a maximum of 0.50% by weight, reduction annealing the melt in a temperature range of 850°–950° C., soft annealing and adding conventional lubricants, forming the powder mixture into green compacts, compressing the green compacts by simple compression techniques at a pressing pressure 6.0 to 8.0 t/cm$^2$, and subsequently sintering the compressed compacts at a temperature in a range of 1050°–1350° C. under an atmosphere containing at least 10% by volume hydrogen.

* * * * *